United States Patent [19]

Bachmann

[11] Patent Number: 4,832,527

[45] Date of Patent: May 23, 1989

[54] VERTICALLY RECIPROCABLE GATES FOR THE CONTROL OF A LIQUID MEDIA

[75] Inventor: Lothar Bachmann, Auburn, Me.

[73] Assignee: Bachmann Company, Inc., Lewiston, Me.

[21] Appl. No.: 102,117

[22] Filed: Sep. 29, 1987

[51] Int. Cl.[4] ..... E02B 7/26

[52] U.S. Cl. ..... 405/105; 49/216; 405/103; 405/87

[58] Field of Search ..... 405/104, 105, 87; 49/246, 216; 251/158, 203, 204

[56] References Cited

U.S. PATENT DOCUMENTS

| | | | |
|---|---|---|---|
| 3,290,888 | 12/1966 | Palmer et al. | 405/105 |
| 3,319,425 | 5/1967 | Andrae | 405/105 |
| 3,401,527 | 9/1968 | Palmer et al. | 405/105 |
| 3,841,024 | 10/1974 | Cheng | 49/216 X |
| 4,265,564 | 5/1964 | Watelet | 405/105 |

*Primary Examiner*—Dennis L. Taylor

[57] ABSTRACT

A vertically reciprocable gate assembly which includes a frame surrounding a port and a gate having a gate member connected by links to an actuating member which is slidably connected to the frame with the gate member between it and the frame. Unless the gate is closed, the gate member is held against the actuating member and out of sealing contact with the frame. When the gate is lowered, it engages a stop which establishes a predetermined position of the gate member relative to the port, further downward movement of the actuating member causes the links to thrust the gate member into its operative position.

3 Claims, 4 Drawing Sheets

VERTICALLY RECIPROCABLE GATES FOR THE CONTROL OF A LIQUID MEDIA

BACKGROUND OF THE INVENTION

Gates which are vertically reciprocable between open and closed positions are used in various systems such, for examples, as, when flow volumes through sluices, weirs and aqueducts are large typically for the control of water which may be and often is waste waters or other liquids.

The requirements of such gates illustrate the problems with which the present invention is concerned. Movement of such a gate between its open and closed positions is attended by frictional resistance which factor and the size of the gate determine the type of mechanism to be used to reciprocate it. The prime requirement of any such gate is that it be operable to seal effectively the port it controls and attendant friction adversely affects seal life.

THE PRESENT INVENTION

The general objectives of the present invention are to provide vertically movable gates which are operable to sesal a port effectively when in their closed positions with frictional resistasnce in their reciprocation minimized and damage to their seals due to such movements eliminated or held to a minimum.

In accordance with the invention, these objectives are attained by providing vertically reciprocable gate assemblies which include a gate and a frame with the frame shaped and dimensioned to surround the port through which flow is to be controlled. The frame has parallel, vertical slideways, one on each side of the port. The gate includes a gate member and an actuating member with the actuating member slidably connected to the slideways of the frame and the gate member between the frame and the actuating member and connected to the latter for limited movement towards or away therefrom. Either the frame or the gate member is provided with a seal disposed to surround the port and block flow therethrough when the gate is closed.

One of the gate members is provided with means by which it can be raised and lowered and carries the other gate member with it until, as the gate is being lowered, said other member engages a stop which does not prevent further downward movement of said one member which further movement is limited by the connection between the two gate members. The connection is such that the two gate members are or may be in mutual contact with the gate member held spaced from the frame except when the gate is closed. As previously stated the further movement of said one member results in the gate member being thrust away from the actuating member and against the frame to effect seal engagement. The gate member is thus held spaced from the frame while being raised and lowered but is thrust forcibly into its port closing position by the weight of the actuating member sealing the gate member to the frame during said short final movement.

An important feature of the invention is that the actuating member of the gate has sides extending into the slideways and provided with retainers therein. The gate member has side flanges with the connection between the two members of the gate being a series of links pivotally connected to the side flanges and to mounts fixed on the actuating member and downwardly inclined from that one of the gate members to which the means for raising and lowering the gate are directly connected.

Other objectives and important features of the invention will be apparent from the following description of a preferred embodiment and the appended claims.

BRIEF DESCRIPTION OF THE DRAWINGS

The accompanying drawings illustrate a preferred embodiment of the invention

THE PREFERRED EMBODIMENT OF THE INVENTION

Figure 1:
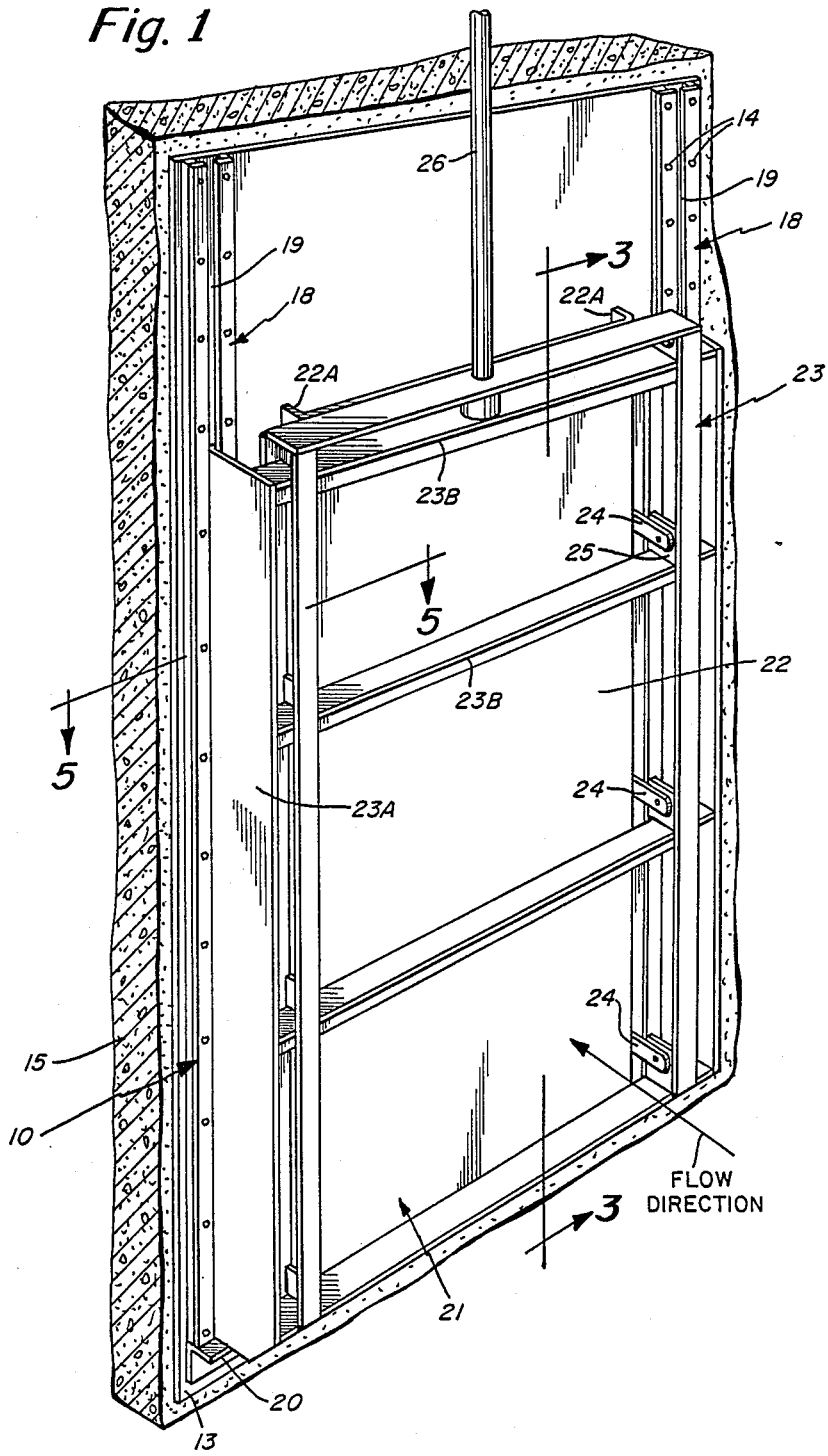
FIG. 1 is a view, in perspective, of an installed vertically reciprocable gate assembly with the gate members positioned as they are when the gate is closed.
Figure 2:
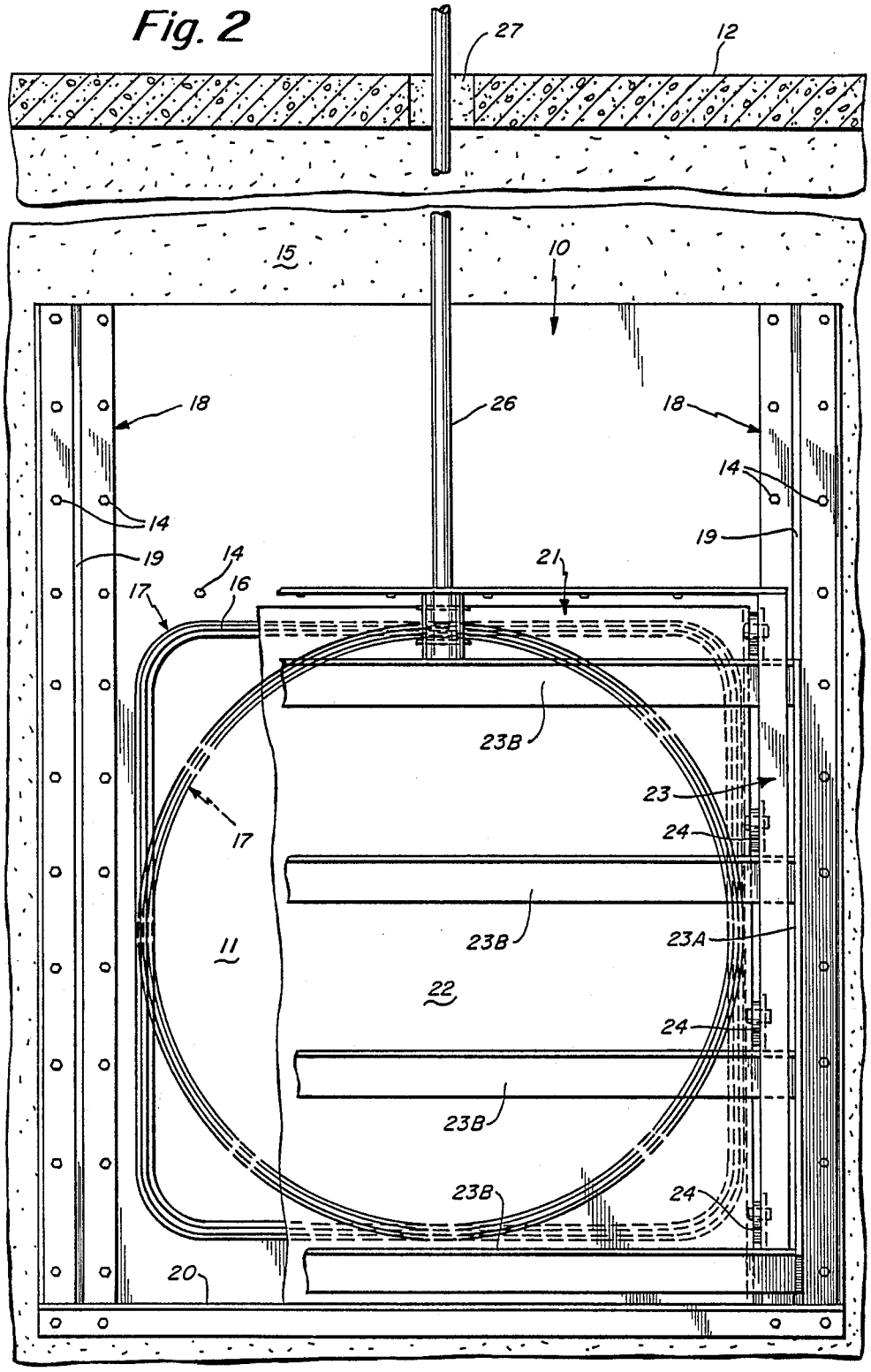
FIG. 2 is a view of the installed vertically reciprocable gate with the gate members partially broken away to show the seat and the slideways.
Figure 3:
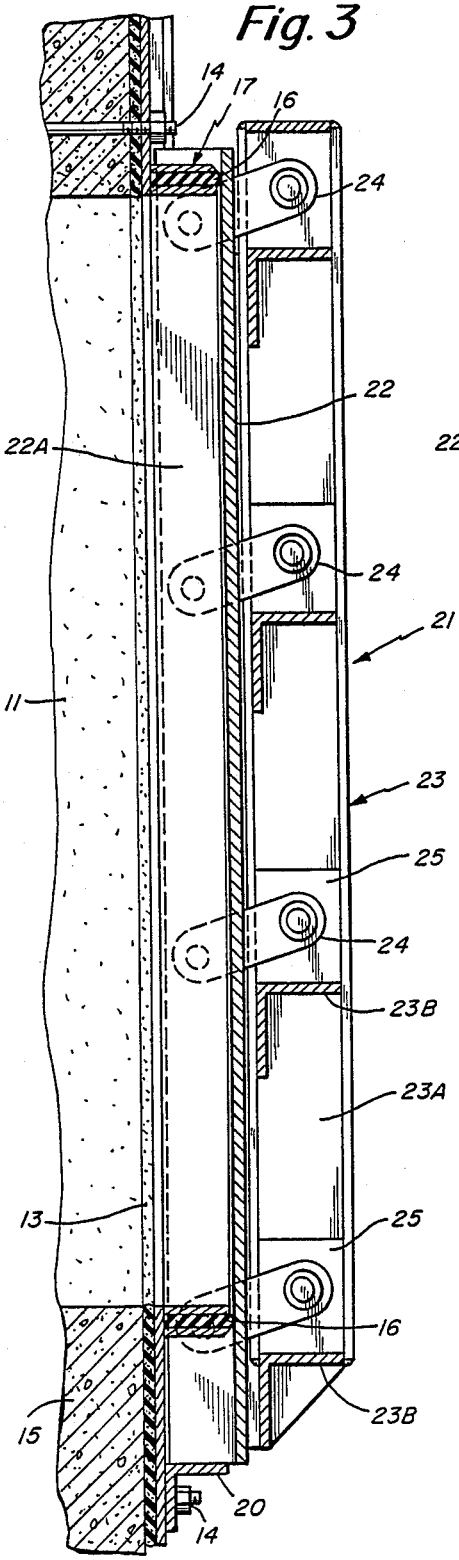
FIG. 3 is a section taken approximately along the indicated line 3—3 of FIG. 1.

The gate assembly in accordance with the invention and illustrated by the drawings has a frame 10 surrounding a port 11 below a floor 12 with the frame 10 shown secured against a sealing layer 13, typically grouting, by anchors 14 extending into concrete 15.

Figure 5:
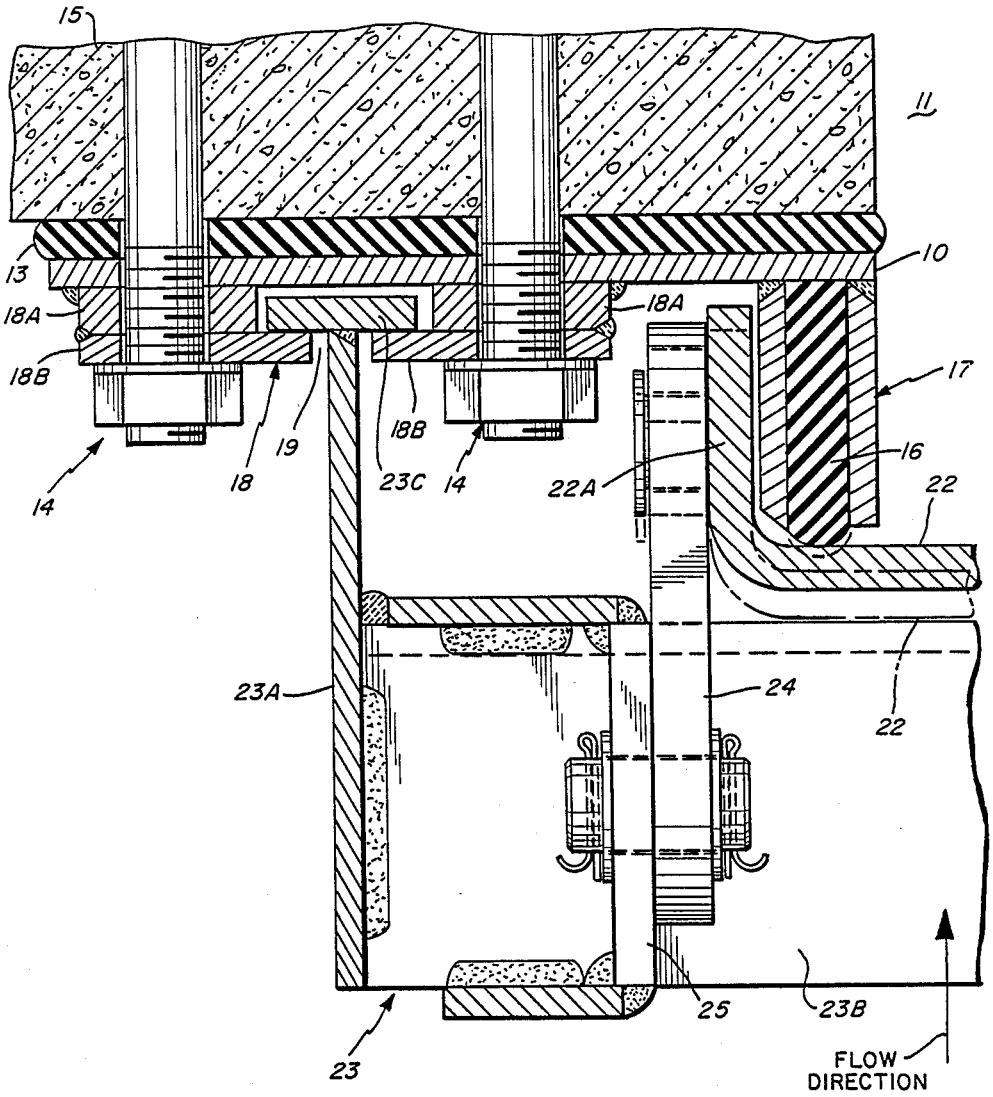
FIG. 5 is a section, on a substantial increase in scale, taken approximately along the indicated line 5—5 of FIG. 1.

The port 11 is surrounded by a seal 16 held by a holder 17 welded to the frame 10 and shown as rectangular except for its arcuate corners. Laterally of the sides of the holder 17 there are slideways, generally indicated at 18 and shown in FIG. 5 as formed by vertical spacers 18A and overlying retainers 18B with the retainers 18B spaced apart to provide lengthwise slots 19 which are open at their upper ends. The other ends of the slots 19 are closed by a transverse shelf or stop 20. In practice and as shown, the anchors 14 extend through the margins of the slideways.

The gate of the assembly is generally indicated at 21 and consists of a gate member 22 and an actuating member 23. The gate member 22 is shown as a rectangular metal plate having sides 22A disposed at right angles to and towards the frame 10. The actuating member 23 is a thrust rack or frame having its side walls 23A interconnected by a vertically spaced series of transverse stiffeners or shelves 23B of substantial width and right angular in cross section.

The actuating member 23 is of a width such that it extends beyond the sides of the gate member 22 with its end walls 23A extending beyond the sides of the gate member and into the entrance slot 20 of the slideways 18 and with retainers 23C welded to the ends thereof and caught within the slideways.

A series of links 24 are pivotally connected to the outer face of each side 22A of the gate member 21 and to the closed ends of U-shaped mounts 25 welded to the stiffeners 23B and to the side walls 23A of the actuating member 23.

Figure 4:
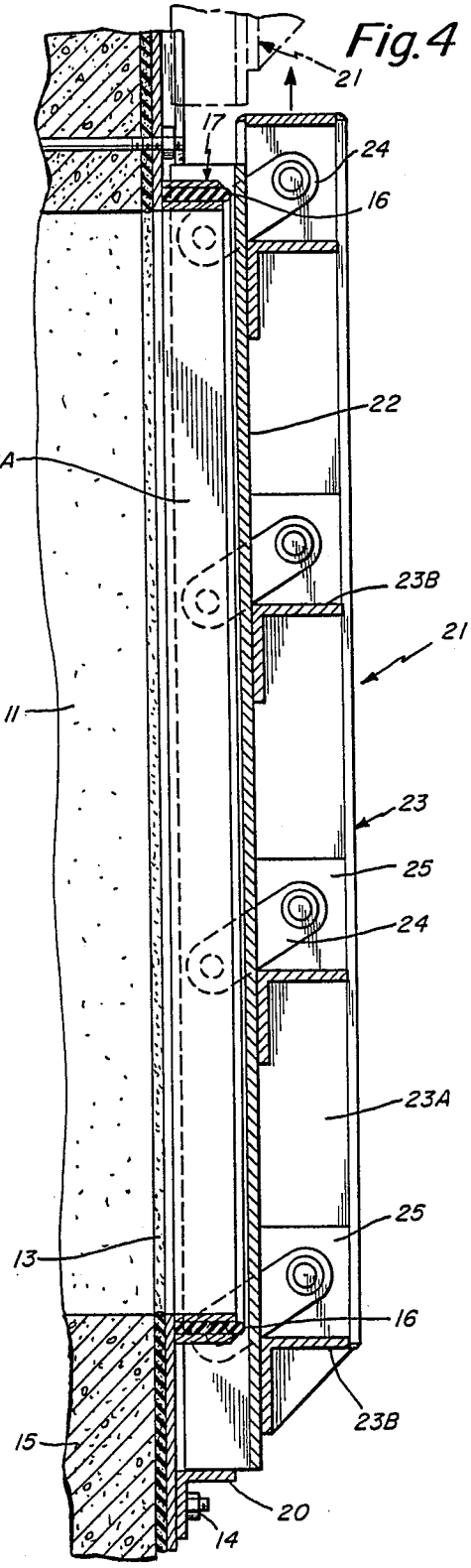
FIG. 4 is a like view showing the gate members as they are positioned except when the gate is closed.

The actuating member 23 is shown as having a lifter in the form a rod 26 connected to the center of the top stiffener 23B and extending upwardly through a hole 27 in the floor 12. It will be apparent from FIG. 4 that whenever the gate 21 is even part way open, the links 24 are downwardly inclined with respect to the atuating member 23 and the gate member 22 rests against the actuating member and is spaced out of contact with the seal 16 and its top and bottom is held below the top and bottom, respectively, of the actuating member 23.

The path of the gate 21 as it moves vertically is fixed by the connection of the actuating member 23 to the slideways 18 with the gate member 22 held by the links 24 against the actuating member 23 and the gate member 22, when moving, held from contact with the seal 16. When the gate 21 is lowered to block flow through the port 11, the gate member 22 is stopped when it is in a predetermined position relative to the seal 16 as by contact of the bottom end of the gate member 22 with the stop 20. The actuating member 23 is free to descend further and, in so doing, the weight of the actuating member forces the links 24 to assume positions more nearly normal relative thereto and exert a thrust on the gate member 22 forcing it into sealing engagement with the seals thus effectively sealing the port 11.

I claim:

1. A vertically reciprocable gate assembly for use in blocking flow through a port, said assembly including a frame surrounding the port in a plane normal to the flow path therethrough, said frame providing with a seal surrounding the port and vertical slideways between which the seal is located, an actuating member, a gate member between the actuating member and said plane, links pivotally connecting the members and downwardly inclined with respect to the actuating member, means connected to the actuating member and operable to effect the raising and lowering thereof between upper and lower limits, said actuating member slidably held by the slideways, said slideways of a length to hold the actuating member throughout its travel between said limits, a stop engageable by the gate member as the actuating member is being lowered but before the lower limit of travel is reached by the actuating member, the gate member then in a position intersecting the flow path but spaced from the seal, the uninterrupted, continuing downward travel of the actuating member seating the gate member against the seal as the links assume a more normal relationship with respect to the actuating member.

2. The vertically reciprocable gate assembly of claim 1 in which the seal includes a holder in the form of a channel welded to the frame and opening towards the position of the gate member when seated against the stop and the seal is seated in the channel and is dimensioned to protrude therefrom, the gate member is a plate dimensioned to overlie the seal and includes sides disposed at right angles towards the frame and receiving between them corresponding portions of the seal, and corresponding ends of the seal are pivotally connected to the outer surfaces of the sides.

3. The vertically reciprocable gate assembly of claim 2 in which the actuating member is wider than the gate member and includes side members and transverse connecting members, the side members including end portions caught in the slideways, mounts welded to the side and transverse members and the other ends of the links are pivotally connected to the mounts.

* * * * *